US008464400B2

(12) United States Patent
Dilo

(10) Patent No.: US 8,464,400 B2
(45) Date of Patent: Jun. 18, 2013

(54) METHOD FOR OPERATING A FLEECE LAYER

(75) Inventor: Johann Phillipp Dilo, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 0 days.

(21) Appl. No.: 13/492,243

(22) Filed: Jun. 8, 2012

(65) Prior Publication Data

US 2013/0014349 A1 Jan. 17, 2013

(30) Foreign Application Priority Data

Jun. 20, 2011 (EP) ..... 11170544

(51) Int. Cl.
*D01G 25/00* (2006.01)

(52) U.S. Cl.
USPC ..... 19/163; 19/302

(58) Field of Classification Search
USPC ..... 19/161.1, 163, 296, 300, 302
See application file for complete search history.

(56) References Cited

U.S. PATENT DOCUMENTS

| | | | | |
|---|---|---|---|---|
| 3,877,628 | A | 4/1975 | Asselin et al. | |
| 6,195,844 | B1 | 3/2001 | Jourde et al. | |
| 6,434,795 | B1 * | 8/2002 | Jourde et al. | 19/161.1 |
| 7,320,155 | B2 * | 1/2008 | Leger | 19/296 |
| 7,895,715 | B2 * | 3/2011 | Leger | 19/296 |
| 2010/0043179 | A1 * | 2/2010 | Leger | 19/296 |
| 2012/0180264 | A1 * | 7/2012 | Dilo | 19/296 |
| 2012/0180265 | A1 * | 7/2012 | Dilo | 19/296 |

FOREIGN PATENT DOCUMENTS

| | | | |
|---|---|---|---|
| DE | 4010174 | A1 | 10/1991 |
| EP | 1532302 | B | 4/2006 |
| EP | 1381721 | | 6/2006 |
| EP | 1897979 | A2 | 3/2008 |
| WO | WO02101130 | A1 | 12/2002 |
| WO | WO2004013390 | A1 | 2/2004 |

* cited by examiner

*Primary Examiner* — Shaun R Hurley
(74) *Attorney, Agent, or Firm* — Jansson Munger McKinley & Shape Ltd.

(57) ABSTRACT

The method for operating a fleece layer requires a fleece layer, to which the card web is supplied at variable card web infeed speed. To limit the amount of space required for the upper carriage at the rear of the machine, the average of the absolute values of the laying-carriage speed during the forward movement of the laying carriage in at least some laying cycles differs from the average of the absolute values of the laying-carriage speed during the return movement of the laying carriage, and the average of the absolute values of the laying-carriage speed in at least some laying cycles during the forward movement of the laying carriage differs from twice the average of the absolute values of the upper-carriage speed during the forward movement of the laying carriage.

5 Claims, 6 Drawing Sheets

METHOD FOR OPERATING A FLEECE LAYER

CROSS REFERENCE TO RELATED APPLICATION

This application claims priority based on European patent application EP 11 170 544.8, filed Jun. 20, 2011.

FIELD OF THE INVENTION

The present invention relates to a fleece layer for producing a fleece from a card web.

BACKGROUND OF THE INVENTION

Fleece layers are used to lay multiple layers of a card web, produced by a carding machine, as uniformly as possible on an output conveyor belt. The card web is usually guided first through an upper carriage and proceeds from there to a laying carriage, through the laying gap of which the card web is deposited onto the output conveyor belt. At least two card web conveyor belts are used to guide the card web through the fleece layer. The movements of the card web conveyor belts, of the upper carriage, and possibly of the laying carriage are controlled so as to coordinate with each other.

Fleece layers are often preceded by mechanisms for changing the web line speed. Such mechanisms are used primarily to regulate the density of the card web as a way of profiling the laid fleece or to compensate for a thickness variation at the edges of the laid fleece. Mechanisms of this type for changing the line speed include, for example, take-off rolls, driven at different speeds, on the carding machine located upstream of the fleece layer, as known from U.S. Pat. No. 6,195,844, for example, or a separate web drafter, which can be installed between the carding machine and the fleece layer (see, for example, EP 1 532 302 B1).

In both of the patent documents cited above, fluctuations in the line speeds of the incoming web are compensated for in the fleece layer by an integrated buffer, which is obtained by increasing the distance traveled by the upper carriage. This results in turn in an increase in the length of the loop in the first web conveyor belt. Because of the greater distance traveled by the upper carriage, the rear part of the fleece layer becomes longer, which is often undesirable and can exceed the amount of setup space available.

SUMMARY OF THE INVENTION

It is an object of the present invention to provide a fleece layer which makes it easy to compensate for fluctuating card web infeed speeds and which simultaneously minimizes the amount of space which the fleece layer requires at the rear.

According to an aspect of the invention, the method for operating a fleece layer for producing a fleece from a card web includes the steps of providing a fleece layer comprising an upper carriage, which moves in the transverse direction and through which a card web produced by a fiber web-forming device is conducted, and further including a laying carriage, which moves in the transverse direction, through which the card web coming from the upper carriage is conducted. The laying carriage serves to deposit the card web onto an output conveyor belt. The fleece layer also includes at least two card web conveyor belts to guide the card web to the laying carriage.

According to a further aspect of the invention, the method includes providing a speed changing device installed upstream of the fleece layer or integrated into its infeed area for temporarily changing the speed of the card web, as a result of which the card web is supplied to the fleece layer at a variable card web infeed speed.

The upper carriage and the laying carriage may be moved back and forth substantially in the same direction during a laying cycle by means of forward and return movements, wherein the laying carriage, during each laying cycle, moves back and forth between two permanently defined reversal points.

The average of the absolute values of the laying-carriage speed during the forward movement of the laying carriage in each laying cycle or at least in some laying cycles differs from the average of the absolute values of the laying-carriage speed during the return movement of the laying carriage. The average of the absolute values of the laying-carriage speed during the forward movement of the laying carriage in each laying cycle or at least in some laying cycles differs from twice the average of the absolute values of the upper-carriage speed during the forward movement of the laying carriage.

It is thus possible to compensate for variable card web infeed speeds in a simple manner and at the same time, thanks to the limited distance which the upper carriage must travel, to limit the amount of space required at the rear of the fleece layer.

The average of the absolute values of the laying-carriage speed during the forward movement of the laying carriage in each laying cycle or at least in some laying cycles is preferably greater than twice the average of the absolute values of the upper-carriage speed during the forward movement of the laying carriage. The average value of the laying-carriage speed during the forward movement of the laying carriage in each laying cycle or at least during some laying cycles is greater than the average value of the laying-carriage speed during the return movement of the laying carriage. Thus the laying carriage catches up with the upper carriage more quickly during the forward movement, which has the effect of taking-up the loop which the belt forms around the upper carriage. Nevertheless, even though the card web infeed speed can be higher at times during the forward movement, the distance traveled by the upper carriage can still be limited to a certain value. Simultaneously, the higher card web infeed speed is compensated for by the higher asynchronous speed of the laying carriage during its forward movement.

To maintain a constant mass flow, it is advantageous for the average of the absolute values of the laying-carriage speed after several laying cycles to be the same as the average of the absolute values of the variable card web infeed speed.

It is especially preferable for the average of the absolute values of the laying-carriage speed to be the same after each laying cycle as the average of the absolute values of the variable card web infeed speed. This makes it possible to establish a constant mass flow during every laying cycle, and the compensation during following laying cycles can be carried out with greater flexibility.

To limit the amount of space which the fleece layer requires in the rear area more effectively (i.e., to reduce it to a minimum), it is advantageous to define physically two predetermined reversal points for the upper carriage and to set up the speed profile of the laying carriage in such a way that the upper carriage does not travel beyond these predetermined reversal points no matter what the variable card web infeed speed of the incoming card web might be.

BRIEF DESCRIPTION OF THE DRAWINGS

In order that the features and advantages of the invention will be readily understood, a more detailed description of the invention briefly described above will be rendered by reference to specific embodiments and examples that are illustrated in the appended drawings. Understanding that these drawings depict only typical embodiments of the invention and are not therefore to be considered to be limiting of its scope, the invention will be described and explained with additional specificity, features, advantages and detail through the use of the accompanying drawings, in which.

DETAILED DESCRIPTION OF THE INVENTION

Figure 1:
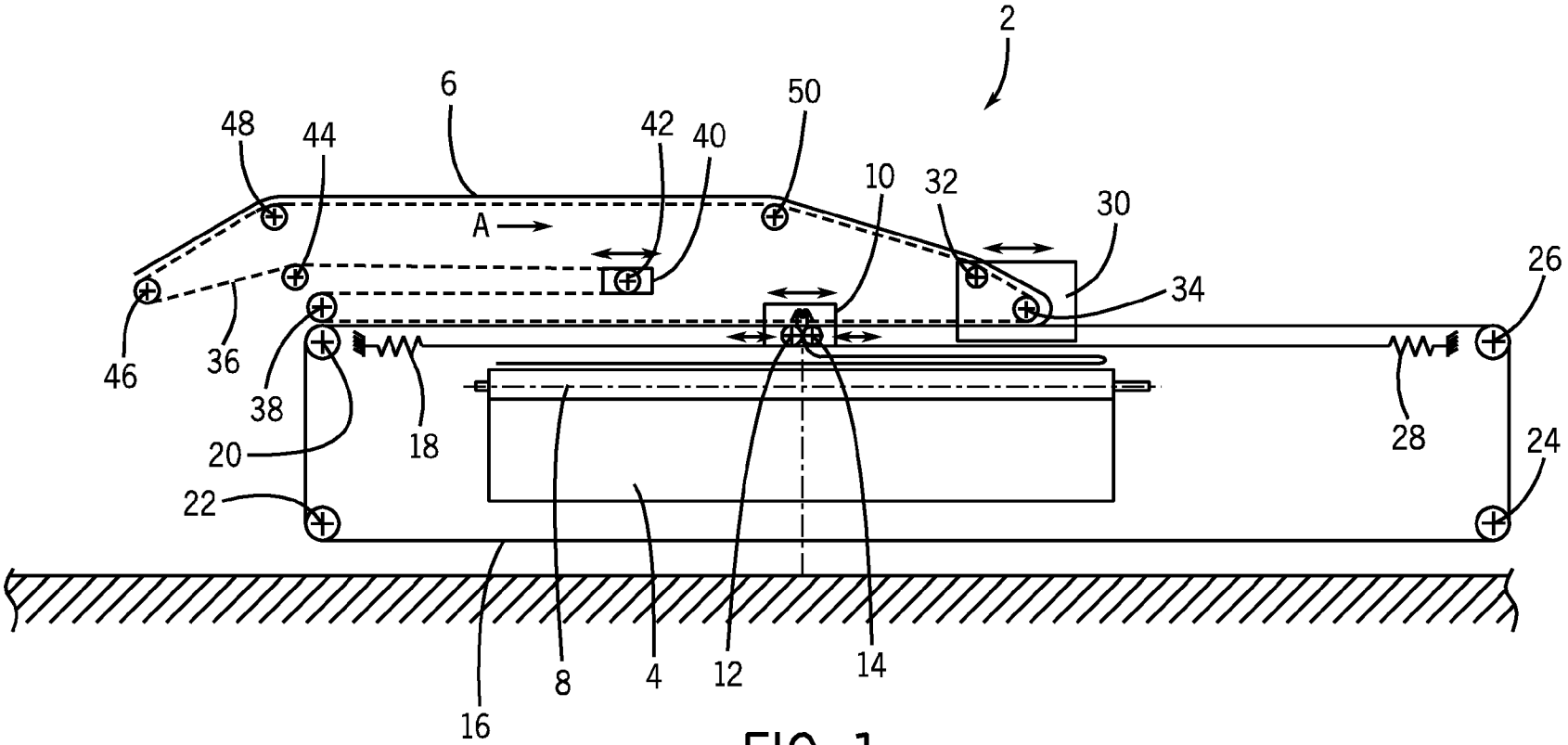
FIG. 1 is a schematic cross-sectional diagram of one embodiment of a fleece layer in which the invention can be applied.

FIG. 1 is a schematic cross-sectional diagram of a fleece layer 2 in which the present invention can be applied. Fleece layer 2 has an endless output conveyor belt 4, which is intended to carry away the fleece produced from a card web 6 in a transport direction perpendicular to the plane of the drawing. An upper deflecting roll 8, which represents one of the guide devices of output conveyor belt 4, is shown.

A laying carriage 10 can be moved back and forth on rails or pipes (not shown) above output conveyor belt 4. Two freely rotatable deflecting rolls 12 and 14 are supported in laying carriage 10. A web conveyor belt 16, also called the "second web conveyor belt 16" below, wraps part of the way around first deflecting roll 12. At its first end 18, the second web conveyor belt 16 is permanently connected to the machine stand (not shown) of fleece layer 2 and extends from there above and only a short distance away from output conveyor belt 4 until it reaches laying carriage 10, where it reverses direction by 180° and is then guided back over four stationary deflecting rolls 20, 22, 24, 26 before arriving back at second deflecting roll 14 in the laying carriage. The second web conveyor belt 16 wraps part of the way around deflecting roll 14, which is also supported in freely rotatable fashion in laying carriage 10. Web conveyor belt 16 thus reverses its direction here by 180° and then proceeds from the lower outlet area of laying carriage 10, passing only a short distance above output conveyor belt 4, to the machine stand of fleece layer 2, to which its second end 28 is also permanently attached.

On laying carriage 10, a chain or a toothed belt is mounted, which passes, for example, over a drive gear wheel connected to a motor and a deflecting roll (none of these elements is shown). By means of these drive devices, laying carriage 10 can be moved back and forth above output conveyor belt 4 crosswise to the transport direction of the belt.

At about the same height as laying carriage 10, an upper carriage 30 is supported on rails or pipes (not shown) in the machine stand of fleece layer 2 so that it can move crosswise to the transport direction of output conveyor belt 4. The rails or pipes can be the same rails or pipes as those on which laying carriage 10 is also movably supported. Upper carriage 30 has an upper deflecting roll 32 and a lower deflecting roll 34, which are offset laterally from each other. Another web conveyor belt 36, called the "first web conveyor belt 36", passes over these two deflecting rolls 32, 34. In the area bounded by two deflecting rolls 32, 34 in upper carriage 30, the first web conveyor belt 36 passes downwards at a slant.

Proceeding from lower deflecting roll 34 in upper carriage 30, first web conveyor belt 36 extends parallel to the right upper run of second web conveyor belt 16. First web conveyor belt 36 extends in a straight line through laying carriage 10, and, after leaving laying carriage 10, it passes over a stationary, motor-driven deflecting roll 38. From there, it is guided around a deflecting roll 42 supported in a tension carriage 40 and then proceeds over several stationary deflecting rolls 44, 46, 48, 50 supported in the machine stand of fleece layer 2 before reaching upper carriage 30 again. Upper carriage 30 and tension carriage 40 can be connected to each other by a chain or a toothed belt (not shown), which passes over a drive gear wheel connected to a motor and a deflecting pulley, which are mounted in the machine stand (not shown). Tension carriage 40 is also supported on rails or pipes (not shown), so that it can move back and forth. It can also be advantageous for the movements of upper carriage 30 and those of tension carriage 40 to be isolated from each other.

In the area between lower deflecting roll 34 of upper carriage 30 and second deflecting roll 14 of laying carriage 10, sections of first web conveyor belt 36 and of second web conveyor belt 16 are guided parallel to, and only a short distance away from, each other, so that card web 6 supplied by first web conveyor belt 36 is sandwiched between first web conveyor belt 36 and second web conveyor belt 16 in the just-mentioned area between upper carriage 30 and laying carriage 10. Card web 6 is supported on second web conveyor belt 16. In addition, the two sections of second web conveyor belt 16 extending between laying carriage 10 and the machine stand of fleece layer 2 simultaneously serve as a cover belt for the deposited fleece.

It can be seen in FIG. 1 that upper carriage 30 and its associated tension carriage 40 move in opposite directions during operation. Tension carriage 40 serves to keep the length of the loop of first web conveyor belt 36 constant.

The movements of laying carriage 10 and of upper carriage 30 are usually coordinated with each other in such a way that, as card web 6 is being supplied at uniform speed to fleece layer 2, card web 6 can be deposited in a controlled manner on output conveyor belt 4 without any stretching or squeezing within fleece layer 2. Upper carriage 30 travels substantially in the same direction as laying carriage 10 but on average only half as fast. Account is also taken of the fact that laying carriage 10 is braked to a stop in the area where it reverses direction and then must be accelerated again. In the area of the reversal points, upper carriage 30 is usually moved for a brief period of time in such a way that it is not traveling in the same direction as laying carriage 10. This, however, is to be considered covered by the phrase "substantially in the same direction". Fleece layers 2 in which upper carriage 30 and laying carriage 10 move substantially in the same direction are also called "co-directional" machines.

A gap, called the laying gap, is formed between two deflecting rolls 12 and 14 in laying carriage 10. During the operation of fleece layer 2, two web conveyor belts 16, 36 are driven in such a way that they travel at the same relative speed in the sandwich area so that they can transport card web 6 without distorting it.

Figure 6:
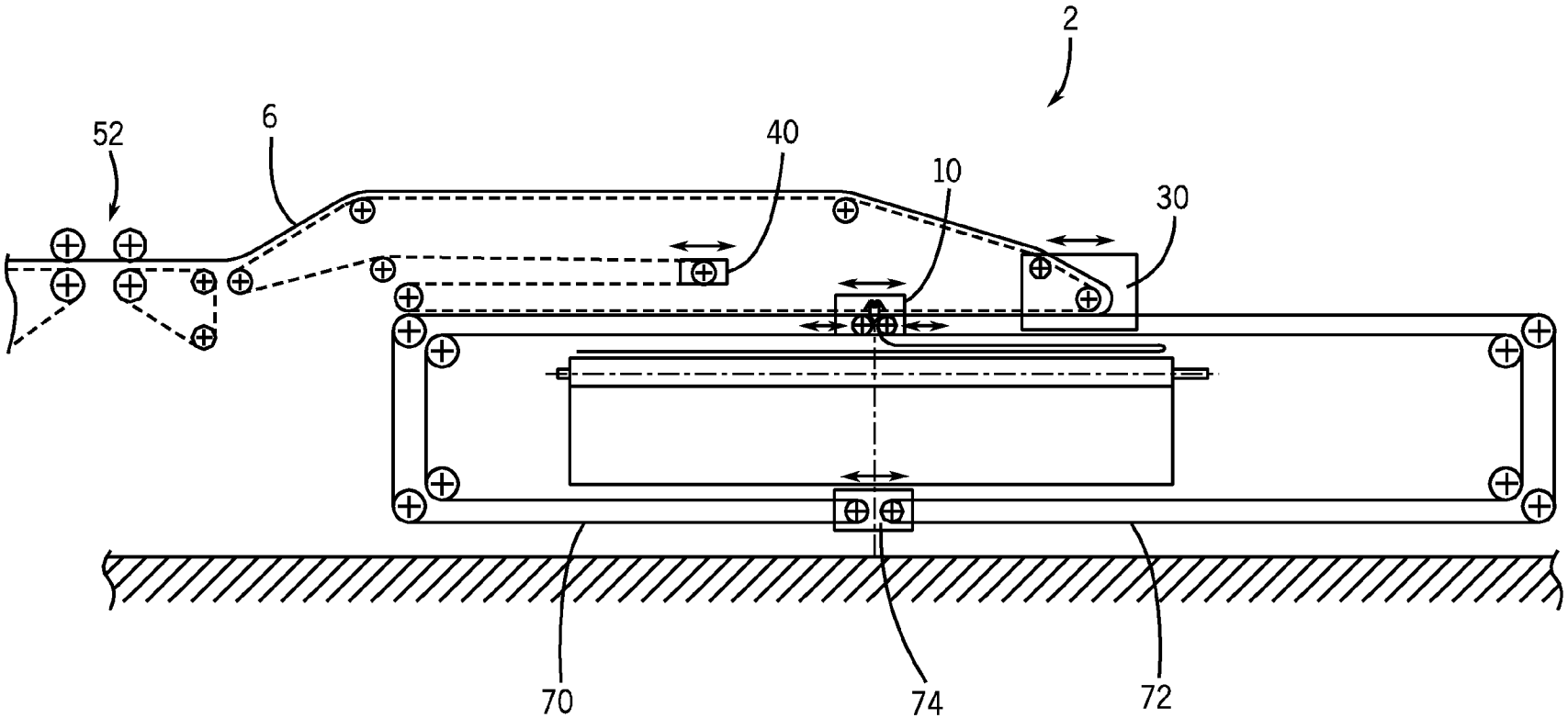
FIG. 6 is a schematic cross-sectional diagram of an additional embodiment of a fleece layer in which the invention can be applied.

According to the invention, card web 6 is supplied to fleece layer 2 at fluctuating card web infeed speed in web travel direction A, because a speed changing device 52 for changing the card web speed is installed upstream of fleece layer 2 or in the infeed area of fleece layer 2 (see FIG. 6). This speed changing device 52 can be a web drafter working in cycles, as shown in FIG. 6, which operates with pairs of clamping rolls to produce areas of alternating thickness in card web 6 for the purpose of achieving a transverse profiling of the laid fleece. A web drafter of this type is described in, for example, EP 1 381 721 B1, the entire content of which is incorporated herein by reference. Other known devices 52 for changing the card web infeed speed can also be used; for example, the card can be equipped with take-off rolls driven at variable speed as described in U.S. Pat. No. 6,195,844.

FIGS. 2, 3*a*, 4*a*, and 5*a* show graphs of speed profiles in the fleece layer, where V is the card web infeed speed as the card web enters fleece layer 2, W is the speed of the laying carriage, and U is the speed of the upper carriage. In all of the graphs mentioned, the speed (in meters per minute) is plotted versus the time (in seconds). The zero point on the time axis establishes the front reversal point $U_0$ of laying carriage 10, i.e., the reversal point of laying carriage 10 on the left in FIGS. 1 and 6. All of the figures show the exact course of a laying cycle, during which laying carriage 10 travels above the output conveyor belt 4 first from the front reversal point $U_0$ toward the rear reversal point $U_1$ (the reversal point located on the right in FIGS. 1 and 6), where it reverses its direction and then proceeds back toward the front reversal point $U_0$, which it reaches at the end of the laying cycle. The forward movement of laying carriage 10 between the reversal points $U_0$ and $U_1$ takes place during the time interval $t_1$-$t_0$, whereas the return movement of the laying carriage between the reversal points $U_1$ and $U_0$ takes place during the time interval $t_2$-$t_1$. The reversal points $U_0$ and $U_1$ of laying carriage 10 are defined in physical space and determine the laying width of fleece layer 2. The laying width of fleece layer 2 may not be changed during operation. Many successive laying cycles are required to form a fleece.

Under the assumption that no additional distortion of card web 6 occurs inside fleece layer 2 between upper carriage 30 and laying carriage 10, the following equations apply to the speed U of the upper carriage at any point in time: forward movement:

$$U = \frac{1}{2}V$$

return movement:

$$U = \frac{1}{2}V + W$$

Figure 2:
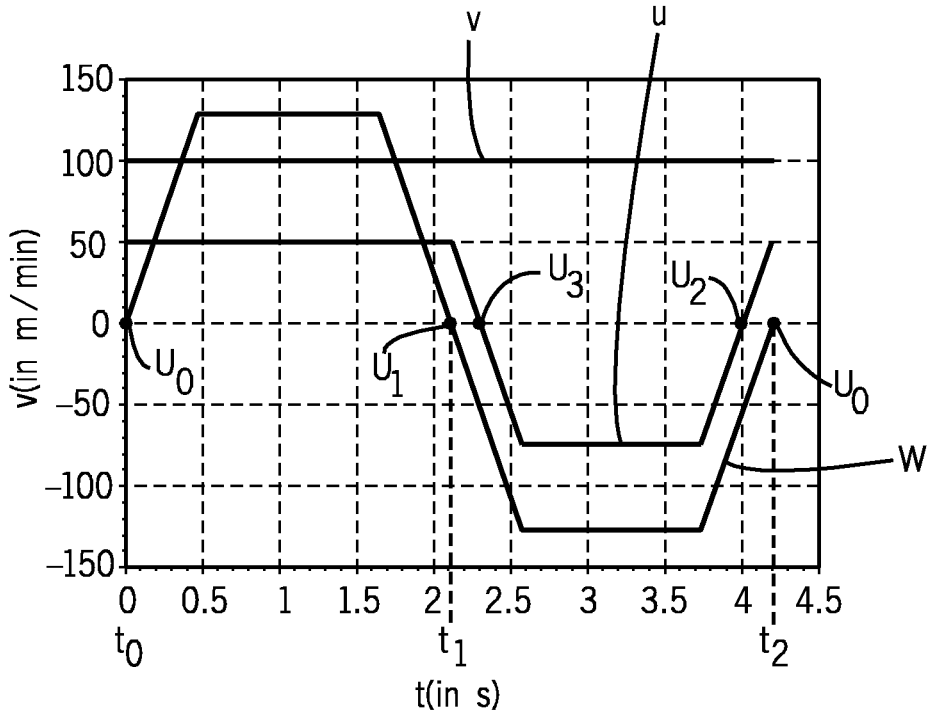
FIG. 2 shows a graph of one example of speed profiles of the card web conveyor belt, of the upper carriage, and of the laying carriage of the fleece layer of FIG. 1 at a constant card web infeed speed.

FIG. 2 shows by way of example the speed profiles in a fleece layer at a constant card web infeed speed V. Because upper carriage 30 is always moving toward the rear at half the card web infeed speed V during the forward movement of laying carriage 10, the speed U of upper carriage 30 is also constant during the forward movement of laying carriage 10. The speed W of laying carriage 10, however, first undergoes a linear increase during its forward movement until it reaches a speed plateau, after which laying carriage 10 is braked and finally changes its direction at the rear reversal point $U_1$ (in the example here at $t_1$=2.10 s). During the normal operation of a conventional fleece layer 2, the two parts of the speed profile of the laying-carriage speed W are identical, except for their sign, during the forward and return movements. In other words, the average of the absolute values of the speed of laying carriage 10 during its forward movement (interval $t_1$-$t_0$) is the same as the average of the absolute values of the speed of laying carriage 10 during its return movement (interval $t_2$-$t_1$). The movement of laying carriage 10 on its forward and return journeys is synchronous. Expressed as a formula, this relationship looks as follows:

$$\frac{\int_{t_0}^{t_1} |W(t)|\,dt}{t_1 - t_0} = \frac{\int_{t_1}^{t_2} |W(t)|\,dt}{t_2 - t_1}$$

Upper carriage 30 continues to travel a short distance after laying carriage 10 has reached its reversal point $U_1$, but then it, too, is braked, and arrives at its own rear reversal point $U_3$ shortly after laying carriage 10 reaches its own reversal point, whereupon the upper carriage is accelerated in linear fashion in the opposite direction until it reaches a speed with an absolute value greater than the constant speed during the forward movement. This speed plateau continues until a braking phase begins, which concludes at the front reversal point $U_2$. Upper carriage 30 then proceeds to accelerate in the opposite direction. In terms of elapsed time, upper carriage 30 thus reaches its front reversal point $U_2$ before laying carriage 10 reaches its front reversal point $U_0$. Then a new laying cycle begins.

There are many different ways in which the speed profiles can be varied, especially with respect to the degree of acceleration, the length of the plateau phases, etc. Nevertheless, it is common to all conventional speed profiles that the average of the absolute values of the upper-carriage speed U during the forward movement of the laying carriage 10 (i.e., while laying carriage 10 is moving from the front reversal point $U_0$ to the rear reversal point $U_1$) is always half of the average of the absolute values of the card web infeed speed V. Expressed as a formula, this means:

$$\frac{\int_{t_0}^{t_1} |U(t)|\,dt}{t_1 - t_0} = \frac{1}{2}\frac{\int_{t_0}^{t_1} |V(t)|\,dt}{t_1 - t_0}$$

During the forward movement of laying carriage 10, furthermore, the average of the absolute values of the speed of laying carriage 10 is twice as high as the average of the absolute values of the speed of upper carriage 30 during the same time period. Expressed as a formula, this means:

$$\frac{\int_{t_0}^{t_1}|W(t)|\,dt}{t_1-t_0}=2\frac{\int_{t_0}^{t_1}|U(t)|\,dt}{t_1-t_0}$$

Expressed in concrete numbers, the speed U of upper carriage 30 in the example of FIG. 2 is constant at 50 m/min during the forward movement of the laying carriage, whereas the average of the absolute values of the speed W of laying carriage 10 during its forward movement is 100 m/min, thus corresponding to the average card web infeed speed V. During the return movement of laying carriage 10, the average of the absolute values of the laying-carriage speed W is also 100 m/min. It can be seen that the laying width, which is 3.5 m in the present case, is traversed once in each direction by the laying carriage in a time of 4.20 s.

All of the relationships expressed above as formulas also apply to the conventional operation of fleece layer 2 under conditions of fluctuating card web infeed speeds V.

Figure 3A:
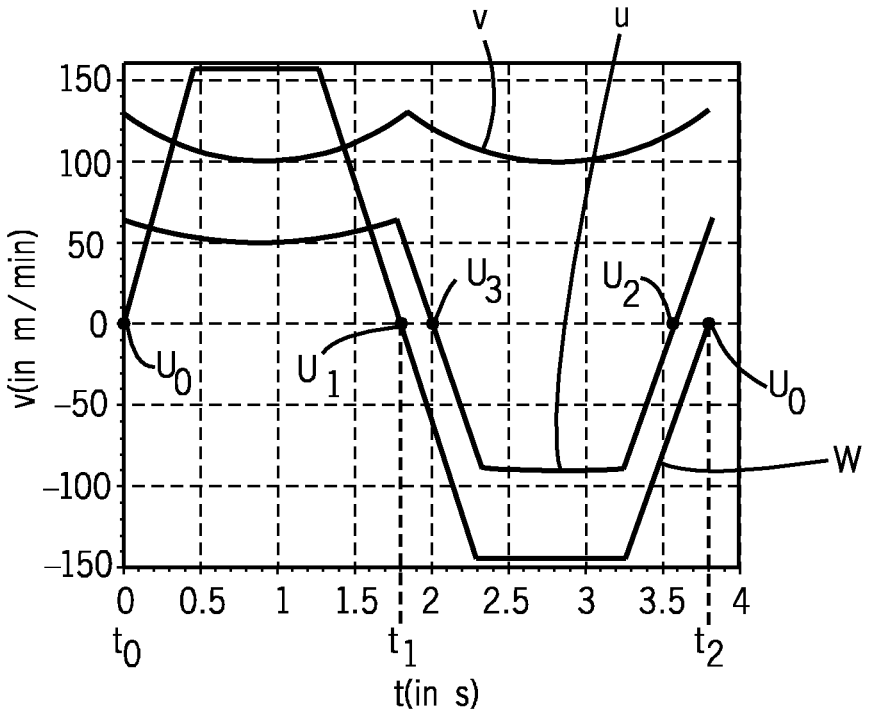
FIG. 3*a* shows a graph of one possibility for the speed profiles of the card web conveyor belt, of the upper carriage, and of the laying carriage of the fleece layer of FIG. 1 at a variable card web infeed speed and with a buffer formation according to the invention.

FIG. 3*a* now shows an example of the operation of fleece layer 2 according to the invention. The first essential point here is that, because of the upstream installation of speed changing device 52 for changing the card web speed, the card web infeed speed V is variable, thus showing a peak-and-valley type of profile. The speed U of the upper carriage 30 during the forward movement of laying carriage 10, i.e., during the time that the laying carriage 10 is moving from the front reversal point $U_0$ to the rear reversal point $U_1$, is again half as great as the card web infeed speed V and thus, in terms of its absolute value, the speed of the upper carriage is equal to half the card web infeed speed V but has the identical speed profile as V. Laying carriage 10 is initially accelerated more quickly during its forward movement and then reaches a speed plateau, which is higher than the continuous card web infeed speed V. The braking process extending up as far as the rear reversal point $U_1$ also proceeds more quickly, whereupon laying carriage 10 is then accelerated in the opposite direction, leading again to a speed plateau. Laying carriage 10 is then braked as it approaches the front reversal point $U_0$. What is conspicuous and especially relevant here is that the increase in the average of the absolute values of the laying-carriage speed W during the forward movement of laying carriage 10 is greater than that during its return movement. This asynchronous increase in the laying-carriage speed W is an essential feature and ensures that the distance traveled by upper carriage 30 is limited. Expressed as a formula, we have:

$$\frac{\int_{t_0}^{t_1}|W(t)|\,dt}{t_1-t_0}>\frac{\int_{t_1}^{t_2}|W(t)|\,dt}{t_2-t_1}$$

This also means that the average of the absolute values of the laying-carriage speed W during the forward movement of laying carriage 10 is greater than twice the average of the absolute values of the upper-carriage speed U during the forward movement of laying carriage 10. Laying carriage 10 therefore travels, on average, more than twice as fast during its forward movement than upper carriage 30 does and catches up with it earlier than is the case with synchronous operation. Expressed as a formula, this means:

$$\frac{\int_{t_0}^{t_1}|W(t)|\,dt}{t_1-t_0}>2\frac{\int_{t_0}^{t_1}|U(t)|\,dt}{t_1-t_0}$$

As can be clearly seen from the graph, a laying cycle now lasts only about 3.80s, which is logical when we consider that the mass flow must remain constant. Constancy of mass flow means in this context that, on average, the average card web infeed speed V of the incoming card web should be the same as the average laying-carriage speed W. Because of the permanently defined laying width of 3.5 m, the laying cycle must necessarily be shorter. It should be noted however, that the laying carriage reaches the rear reversal point $U_1$ after only about 1.80 s and thus considerably before half of the duration of a laying cycle has been completed.

In the example of FIG. 3*a*, the following values may be obtained: average of the absolute values of the speed of laying carriage 10 during its forward movement: 116 m/min; average of the absolute values of the speed of laying carriage 10 during its return movement: 107 m/min; and average of the absolute values of the speed of the upper carriage 30 during the forward movement of laying carriage 10: 55 m/min.

Figure 3B:
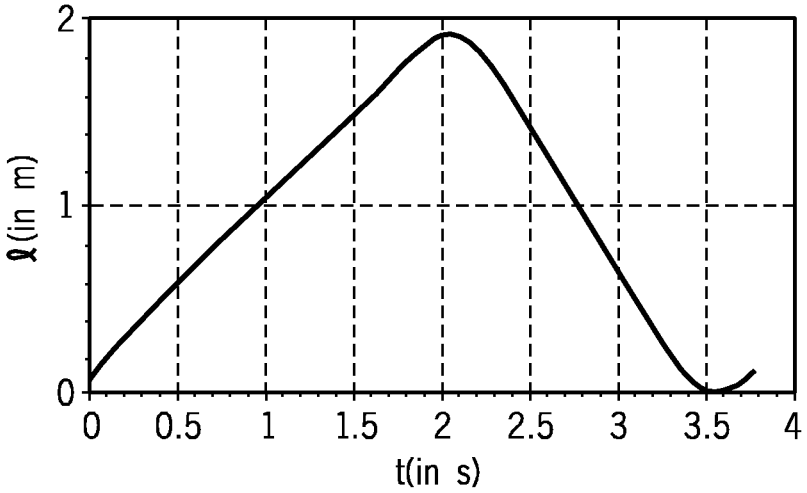
FIG. 3*b* shows a graph of the distance traveled by the upper carriage in the case of the speed distribution according to FIG. 3*a;*

FIG. 3*b* shows a graph of the resulting distance/traveled by upper carriage 30 (in meters). Between its front reversal point $U_2$ and the rear reversal point $U_3$, this carriage travels a distance of exactly 1.90 m.

Figure 4A:
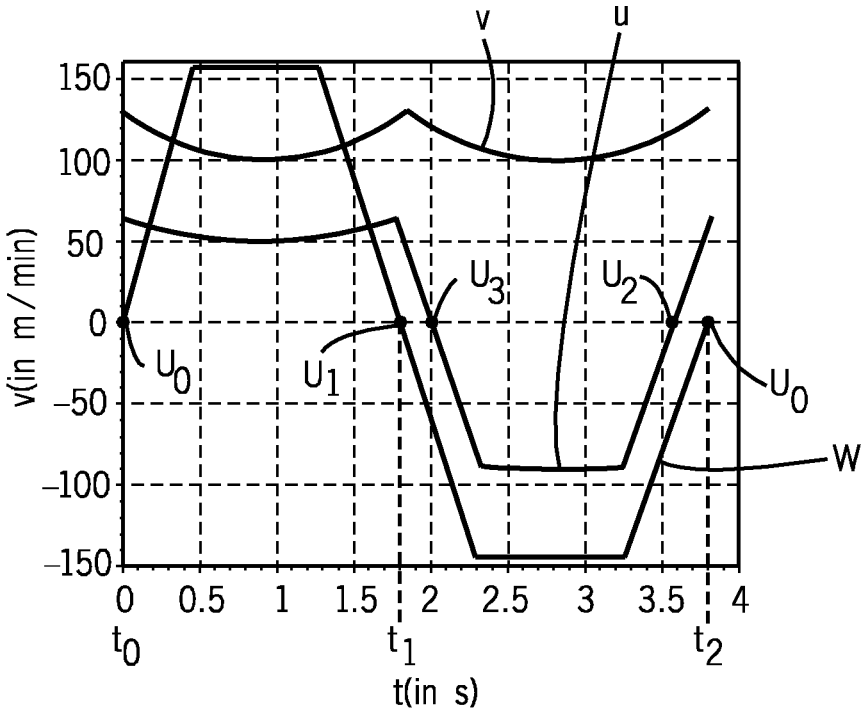
FIG. 4*a* shows a graph of an additional possibility for the speed profiles of the card web conveyor belt, of the upper carriage, and of the laying carriage of the fleece layer of FIG. 1 at variable card web infeed speed and with inventive buffer formation according to the invention.

FIG. 4*a* shows another example of an inventive speed distribution during the operation of fleece layer 2. The example is similar to that shown in FIG. 3*a* with the difference that the acceleration and braking phases of laying carriage 10 are even steeper, and the speed plateaus are accordingly longer, although on a slightly lower level than in the case of the example of FIG. 3*a*. In the example of FIG. 4*a*, the following values may be obtained: average of the absolute values of the speed of laying carriage 10 during its forward movement: 114/min; average of the absolute values of the speed of laying carriage 10 during its return movement: 108 m/min; and average of the absolute values of the speed of upper carriage 30 during the forward movement of laying carriage 10: 55 m/min.

Figure 4B:
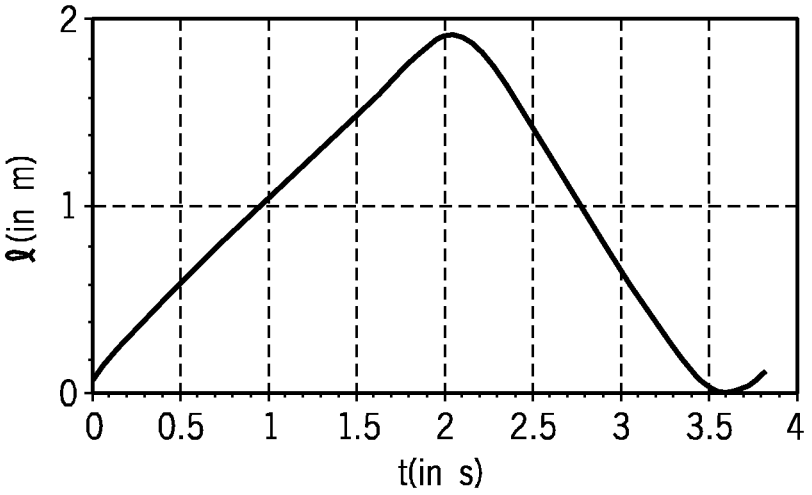
FIG. 4*b* shows a graph of the distance traveled by the upper carriage in the case of the speed distribution according to FIG. 4*a;*

The associated graph of the distance traveled by the upper carriage 30 in FIG. 4*b* shows that the upper carriage 30 again travels a distance/of 1.90 m.

Figure 5A:
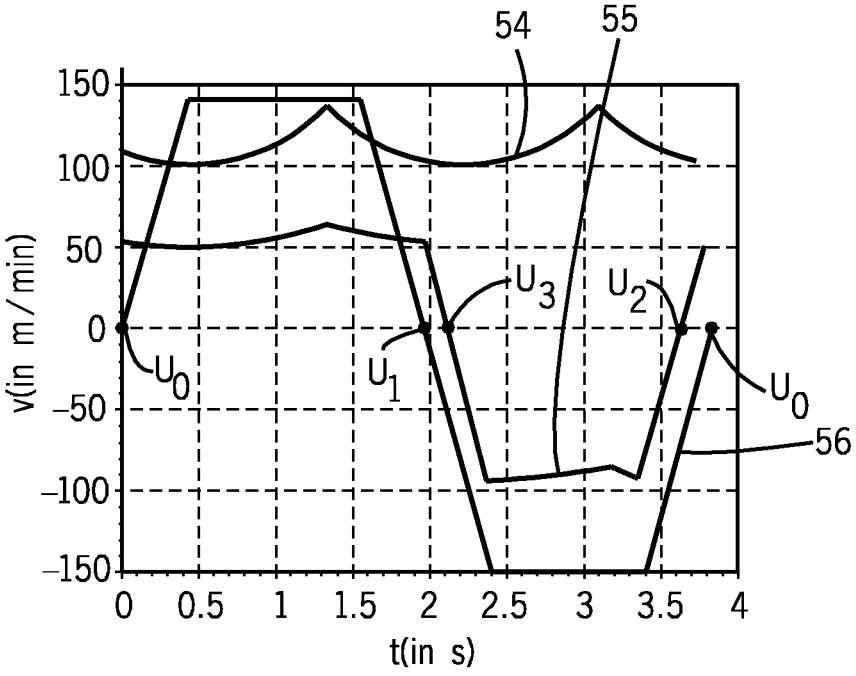
FIG. 5*a* shows a graph of an additional possibility for the speed profiles of the card web conveyor belt, of the upper carriage, and of the laying carriage of the fleece layer of FIG. 1 at a variable card web infeed speed and with a buffer formation according to the invention.

Finally, FIG. 5*a* shows yet another example of inventive speed profiles in fleece layer 2. Here the average of the absolute values of the laying-carriage speed W during the return movement of laying carriage 10 is greater than that during its forward movement. The following formula therefore applies:

$$\frac{\int_{t_0}^{t_1}|W(t)|\,dt}{t_1-t_0}<\frac{\int_{t_1}^{t_2}|W(t)|\,dt}{t_2-t_1}$$

The average of the absolute values of the speed of laying carriage 10 during its forward movement is smaller than twice the average of the absolute values of the speed of the upper carriage 30 during the forward movement of laying carriage 10. Expressed mathematically, it reads:

$$\frac{\int_{t_0}^{t_1} |W(t)|\,dt}{t_1 - t_0} < 2\frac{\int_{t_0}^{t_1} |U(t)|\,dt}{t_1 - t_0}$$

Specifically the following values for the example shown in FIG. 5*a* may be obtained: average of the absolute values of the speed of the laying carriage 10 during its forward movement: 106 m/min; average of the absolute values of the speed of laying carriage 10 during its return movement: 117 m/min; and average of the absolute values of the speed of the upper carriage 30 during the forward movement of laying carriage 10: 56 m/min.

Figure 5B:
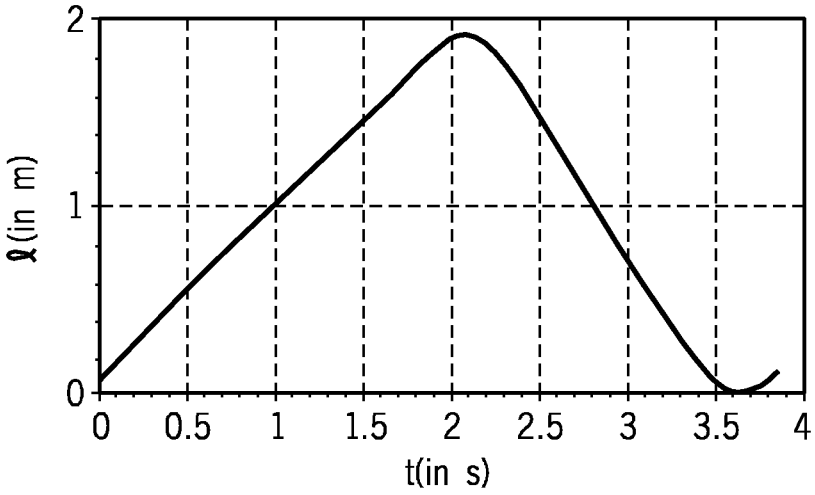
FIG. 5*b* shows a graph of the distance traveled by the upper carriage in the case of the speed distribution according to FIG. 5*a*.

The associated graph of the distance traveled by upper carriage 30 is shown in FIG. 5*b*. It can be seen from this graph that the distance/traveled by upper carriage 30 has increased slightly to 1.96 m. Nevertheless, there is no shift in the rear reversal point $U_3$; instead, it is the front reversal point $U_2$ which is shifted (toward the left in FIGS. 1 and 6,), which has no effect on the physical dimensions of fleece layer 2, because upper carriage 30 reaches a point only about in the middle of fleece layer 2 as it travels toward the front. Care must be taken, however, to ensure that upper carriage 30 does not collide with other components such as tension carriage 40.

Overall, however, embodiments are preferred in which, on average, laying carriage 10 travels faster during its forward movement than during its return movement. When this is realized, it is possible to eliminate completely any increase in the distance traveled by the upper carriage.

It is especially preferable to define physically in space two predetermined reversal points $U_2$, $U_3$ for upper carriage 30 and to adjust the profile of the speed W of laying carriage 10 in such a way that upper carriage 30 does not travel beyond the predetermined reversal points $U_2$, $U_3$ no matter what the variable card web infeed speed V is at which the card web enters fleece layer 2.

Considered overall, there are many different ways in which the speed profiles can be configured. They can also include more stages than in the examples discussed herein. They can, for example, include brief elevations within the plateau area of the laying-carriage speed. In all of the examples discussed herein, furthermore, the speed profiles have been set up so that the starting state is already present again at the end of each laying cycle, which means that the process of compensating for the variable card web infeed speed V has already been completed after one laying cycle. It is also possible, however, to reach this goal only after several laying cycles. For example, the average speed of laying carriage 10 during its forward movement can be set very high during the first laying cycle, and this difference would then be compensated over the course of several return movements during subsequent laying cycles. It is also conceivable that several normal laying cycles with a synchronous laying-carriage speed profile could follow the asynchronous laying cycle as disclosed herein.

According to the embodiments discussed above, a total of two card web conveyor belts 16, 36 are installed in fleece layer 2. The invention can also be applied in other types of fleece layers with two card web conveyor belts and also to any other type of fleece layer designed as a co-directional machine, including those with three belts. An example of a fleece layer of this type with three card web conveyor belts is shown in FIG. 6. In the case of the fleece layer shown in FIG. 6, second card web conveyor belt 16 of the embodiment according to FIG. 1 is replaced by a second card web conveyor belt 70 and third card web conveyor belt 72, which are deflected in a common tensioning carriage 74.

Reference throughout this specification to "the embodiment," "this embodiment," "the previous embodiment," "one embodiment," "an embodiment," "a preferred embodiment" "another preferred embodiment" "the example," "this example," "the previous example," "one example," "an example," "a preferred example t" "another preferred example" or similar language means that a particular feature, structure, or characteristic described in connection with the embodiment or example is included in at least one embodiment or example of the present invention. Thus, appearances of the phrases "in the embodiment," "in this embodiment," "in the previous embodiment," "in one embodiment," "in an embodiment," "in a preferred embodiment," "in another preferred embodiment," "in the example," "in this example," "in the previous example," "in one example," "in an example," "in a preferred example," "in another preferred example, and similar language throughout this specification may, but do not necessarily, all refer to the same embodiment.

Furthermore, the described features, advantages, and characteristics of the invention may be combined in any suitable manner in one or more embodiments or examples. One skilled in the relevant art will recognize that the invention may be practiced without one or more of the specific features or advantages of a particular embodiment or example. In other instances, additional features and advantages may be recognized in certain embodiments or examples that may not be present in all embodiments of the invention.

While the present invention has been described in connection with certain exemplary or specific embodiments or examples, it is to be understood that the invention is not limited to the disclosed embodiments or examples, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

What is claimed is:

1. A method for operating a fleece layer for producing a fleece from a card web, the method comprising:

providing a fleece layer including:

an upper carriage, which moves in a transverse direction and through which a card web produced by a fiber web-forming device is conducted;

a laying carriage, which moves in the transverse direction, through which the card web coming from the upper carriage is conducted, and which is adapted to deposit the card web onto an output conveyor belt; and at least two card web conveyor belts in the fleece layer to guide the card web to the laying carriage;

providing a speed changing device arranged upstream of the fleece layer or integrated into an infeed area of the fleece layer for temporarily changing a speed of the card web, as a result of which the card web is supplied to the fleece layer at a variable card web infeed speed;

whereby the upper carriage and the laying carriage are shifted back and forth substantially in a same direction during each of a plurality of laying cycles by means of forward and return movements, whereby the laying carriage, during each of the plurality of laying cycles, moves back and forth between two predetermined invariable reversal points of the laying carriage;

whereby an average of the absolute values of a laying-carriage speed during forward movement of the laying carriage in each of the plurality of laying cycles or at least in some of the plurality of laying cycles differs from an average of the absolute values of the laying-carriage speed during return movement of the laying carriage; and whereby an average of the absolute values of the laying-carriage speed during forward movement of the laying carriage in each of the plurality of laying cycles or at least in some of the plurality of laying cycles differs from twice an average of the absolute values of an upper-carriage speed during forward movement of the laying carriage.

2. The method of claim 1 wherein the average of the absolute values of the laying-carriage speed during the forward movement of the laying carriage in each of the plurality of laying cycles or at least in some of the plurality of laying cycles is greater than twice the average of the absolute values of the upper-carriage speed during the forward movement of the laying carriage, and wherein the average of the absolute values of the laying-carriage speed during the forward movement of the laying carriage in each of the plurality of laying cycles or at least in some of the plurality of laying cycles is greater than the average of the absolute values of the laying-carriage speed during the return movement of the laying carriage.

3. The method of claim 2 wherein the average of the absolute values of the laying-carriage speed corresponds to the average of the absolute values of the variable card web infeed speed after a predetermined number of the plurality of laying cycles.

4. The method of claim 3 wherein the average of the absolute values of the laying-carriage speed corresponds to the average of the absolute values of the variable card web infeed speed after each of the plurality of laying cycles.

5. The method of claim 1 wherein a spatial arrangement of two predetermined reversal points of the upper carriage is defined, and wherein a profile of the laying-carriage speed is set up in such a way that the upper carriage does not travel beyond the predetermined reversal points of the upper carriage no matter what the variable card web infeed speed is.

* * * * *